US012740652B2

(12) United States Patent
Kui et al.

(10) Patent No.: US 12,740,652 B2
(45) Date of Patent: Sep. 22, 2026

(54) SMART MATTRESS

(71) Applicant: Super Rich Moulders Limited, Hong Kong (CN)

(72) Inventors: Pan Hung Kui, Hong Kong (CN); Man Shan Cheung, Hong Kong (CN)

(73) Assignee: Super Rich Moulders Limited, Hong Kong (CN)

( * ) Notice: Subject to any disclaimer, the term of this patent is extended or adjusted under 35 U.S.C. 154(b) by 93 days.

(21) Appl. No.: 18/838,658

(22) PCT Filed: Mar. 21, 2022

(86) PCT No.: PCT/CN2022/081894
§ 371 (c)(1),
(2) Date: Aug. 15, 2024

(87) PCT Pub. No.: WO2023/178462
PCT Pub. Date: Sep. 28, 2023

(65) Prior Publication Data

US 2025/0151920 A1 May 15, 2025

(51) Int. Cl.
*A47C 27/08* (2006.01)
*A47C 27/10* (2006.01)
*A47C 31/12* (2006.01)

(52) U.S. Cl.
CPC ..... *A47C 27/082* (2013.01); *A47C 27/083* (2013.01); *A47C 27/084* (2013.01); *A47C 27/10* (2013.01); *A47C 31/123* (2013.01)

(58) Field of Classification Search
CPC ... A47C 27/082; A47C 27/083; A47C 27/084; A47C 27/10; A47C 31/123; A61B 5/6892; G01L 1/18
(Continued)

(56) References Cited

U.S. PATENT DOCUMENTS 6,543,299 B2 * 4/2003 Taylor ..... G01L 1/205 73/862.046
8,161,826 B1 * 4/2012 Taylor ..... G01L 1/18 73/862.041
(Continued)

FOREIGN PATENT DOCUMENTS

CN 107149334 A 9/2017
CN 109744785 A 5/2019
(Continued)

OTHER PUBLICATIONS

Extended European Search Report issued on Dec. 3, 2025 by European Patent Office for European Patent Application No. 22932533.7 (Regional Phase Entry).
(Continued)

*Primary Examiner* — David R Hare
(74) *Attorney, Agent, or Firm* — S&F/WEHRW

(57) ABSTRACT

The present invention provides a personalized, interactive, and flexible sleeping posture correction system for use in a large-area bedding article including a mattress such that sleeping posture related data such as different pressure points and change in the pressure distribution over a sleeping cycle can be measured and processed whilst certain adjustment to one or more parameters of the bedding article in response to an instantaneous sleeping posture of a user is executed either automatically by the present system incorporated with artificial intelligence or by the user according to his/her preference of response action(s). In an embodiment, the present system also incorporates a sleeping posture image capturing module for capturing the preceding and instantaneous sleeping postures of the user to enhance the accuracy of the posture prediction and provide more information for the user prior to making a response action decision.

18 Claims, 10 Drawing Sheets

(58) Field of Classification Search
USPC ..... 5/713; 73/862.041, 862.046
See application file for complete search history.

(56) References Cited

U.S. PATENT DOCUMENTS

| | | | | |
|---|---|---|---|---|
| 2006/0085919 | A1* | 4/2006 | Kramer | A61G 7/05776 5/713 |
| 2009/0282930 | A1* | 11/2009 | Cheng | G01L 1/2293 73/862.627 |
| 2012/0323501 | A1* | 12/2012 | Sarrafzadeh | G01L 1/18 702/41 |
| 2014/0090488 | A1* | 4/2014 | Taylor | G01L 1/18 73/862.625 |
| 2014/0243709 | A1* | 8/2014 | Gibson | G01L 1/18 600/587 |
| 2018/0027988 | A1* | 2/2018 | Poodeh | A47C 31/123 |
| 2020/0046136 | A1* | 2/2020 | Blumberg | A61B 5/1116 |
| 2021/0202091 | A1* | 7/2021 | Receveur | A61G 7/05 |
| 2021/0372866 | A1* | 12/2021 | Fu | D06M 23/08 |
| 2022/0260434 | A1* | 8/2022 | Turunen | G01L 1/2287 |
| 2022/0330892 | A1* | 10/2022 | Lee | A61B 5/6892 |

FOREIGN PATENT DOCUMENTS

| | | | | |
|---|---|---|---|---|
| CN | 112841995 | A | 5/2021 | |
| CN | 112867473 | A | 5/2021 | |
| EP | 3397702 | B1 * | 7/2021 | C09D 11/106 |
| WO | 2021041747 | A1 | 3/2021 | |

OTHER PUBLICATIONS

First Office Action of CN Application No. or patent No. 2022111736460 issued from the China National Intellectual Property Administration on May 15, 2025.

* cited by examiner

SMART MATTRESS

TECHNICAL FIELD

The present invention relates to a personalized sleeping posture correction system for bedding article having multiple pressure sensing and adjustable zones either responsive to an instantaneous sleeping posture or according to decisions of a user.

BACKGROUND

Mattress is an essential in a civilized lifestyle of human being. A good mattress can provide support for our whole body, especially from the spine all the way to the hip of our back, to rest and relax during sleeping. However, an inappropriate sleeping posture sometimes could worsen the situation that some of our body parts become more stressful during the sleeping, leading to a bad quality of sleep. Ordinary mattress cannot help in this situation, and sometimes even worse.

Many researchers and mattress manufacturers mainly focused on how to improve the materials of the mattress or distribution of the support force to our body during sleeping. There can be divided into two main streams of mattress available on the market, inner-spring coils and all-foam (or a hybrid of both). Although some materials like memory foam can conform to the shape of our body when pressure is applied and provide pressure relief, it may be too soft to some users. On the other hand, the inner-spring mattress is relatively firmer and provides more pressure point relief, but it may be too firm to some users.

In recent years, bedding products with certain pressure sensing mechanisms have been emerged on the market. Though there may be some mattress products that can monitor pressure distribution during sleeping, active adjustment based on the signal from sensor seems to be missing on the market.

US2021372866A1 disclosed a pressure sensor array having a pressure-sensing substrate including a piezoresistive material printed on a filling portion of a fabric by spraying, and a plurality of pressure-sensing columns separated by a non-filling portion of the fabric. Each of the pressure-sensing columns is fixed (by adhesive or stitching) with top and bottom electrodes in a way to form a periodic electrode row and column between the top and bottom surfaces of the substrate. However, this pressure sensor array neither provides any response actions to any sensed pressure exerted thereon nor independent zones customized to fit the anatomy of human body.

CN107744304A disclosed an air inflatable pillow including a first and two second pressure sensors with an air pump and control mechanism, which was claimed to adjust the air inflated or deflated into different airbags of the pillow body corresponding to the pressure exerted on the first and second pressure sensors by the head and neck in order to optimize the height of the pillow. However, no detail of how the height is optimized corresponding to different pressure distribution exerted by the head and neck of the user is provided in this patent disclosure. That patent disclosure simply described how the inflation and deflation of the airbags are controlled, which appears to be known in the art.

CN208371375U disclosed a seat pad and a device for detecting sitting posture. There was provided a pressure sensor array including two layers of conductive wires where one set of conductive wires (M) on one layer is arranged perpendicular to the other set (N) on the other layer, and the two conductive wire layers sandwich a piece of conductive fibrous layer made of piezoelectric fibers with a large resistance when it is not under compression. This pressure sensor array only contains M+N number of signal outputs, although it has M×N number of sensing points on the pad. A microprocessor unit was also provided in this device to adjust the voltage output from the two conductive wire layers and convert the voltage into digital signal before feeding the same to a CPU. A pressure distribution map was an ultimate product in that patent disclosure after processing those voltage output data by the CPU, in order to suggest what type of sitting posture the user of the seat pad was having during the measurement. However, no interactive/correction function or detail of response mechanism was provided in this patent disclosure for the user to adjust the height of the seat pad.

In a co-pending PCT application under the application number PCT/CN2021/122537, a sensory mat for use in pillow incorporated with a piezoresistive fabric layer sandwiched between two electrode layers is provided, where each electrode layer has conductive and non-conductive portions alternately arranged with each other, and the conductive portions of one electrode layer are arranged perpendicular to those of the other electrode. The pillow also includes a number of airbags arranged differently in various embodiments in order to provide multi-zonal responses corresponding to different pressure distributions arising from different sleeping postures of a user during sleeping. The disclosure of this co-pending application also briefly describes an interactive control and response mechanism to adjust the height of different zones of actuators in the pillow according to contact pressure distribution exerted by different head and neck positions during sleeping. However, when the same mechanism applies to bedding articles with a larger contact surface such as a mattress, it may involve a relative larger scale pressure sensing mechanism and actuating means to counteract any inappropriate sleeping postures.

Therefore, there is a need for a personalized, sleeping posture correction system for bedding articles to overcome or at least mitigate the drawbacks in the prior arts.

SUMMARY OF INVENTION

The present invention provides a system incorporating pressure sensing and imaging techniques to more accurately map pressure distribution exerted by the user and provide a more personalized posture correction instruction to multiple actuators of the system in response to a sleeping posture of a particular user.

In a first aspect, the present invention provides a personalized, system for use in bedding articles, especially for those with a relatively larger contact surface area such as mattress. The present system includes:

- a three-dimensional body for a user thereof to sleep thereon being separated by different pressure sensing and response zones;
- in each of the pressure sensing and response zones, there is provided a pressure sensing and response module including:
  - one or more pressure sensing mechanisms either evenly or unevenly distributed within each of the pressure sensing and response zones of the three-dimensional body;
  - one or more actuators either evenly or unevenly distributed within each of the pressure sensing and response zones of the three-dimensional body; and one or more signal transceivers to receive signals from the pressure sensing mechanisms, transmit signals to the actuators, and/or communicate with one or more devices external to the system, a central processing device receiving pressure data from the one or more signal transceivers, and sending instruction(s) to the one or more actuators.

In certain embodiments, the present system further includes an image processing module including one or more image capturing devices, one or more image processors, and a data transmission device. In those embodiments, the central processing device further receives image data from the data transmission device, and may process and analyse the image data with the pressure data to eventually provide one or more suggestions of pressure level adjustment in one or more pressure sensing and response zones to the user.

In one embodiment, the one or more image capturing devices include one or more motion sensors.

In certain embodiments, the one or more pressure sensing mechanisms include at least one pressure sensing layer, one or more electrodes having both conductive and non-conductive portions arranged in such a way to substantially cover all the pressure points on the contact surface of the bedding article with the user. In order to substantially cover all the pressure points on the contact surface area of the bedding article, the one or more pressure sensing mechanisms is/are configured to be fabricated as thin as possible, e.g., into a sheet form, for maximizing the surface area overlapping the contact surface of the bedding article with the user. It should be understood that the one or more pressure sensing mechanisms is/are not limited to a particular form, provided that it/they can accurately measure the contact point pressure exerted by the user on the contact surface of the bedding article.

In certain embodiments, the pressure sensing layer is not a continuous, single layer. In those embodiments, the pressure sensing layer may be composed of multiple pressure sensors where each of them has its corresponding electrodes. In some embodiments, each pressure sensor, its corresponding electrodes and corresponding actuator(s) define a pressure sensing and response zone of the present system.

In certain embodiments, the one or more actuators include one or more airbags, where air flow direction, volume and/or flow rate in and out of each of the airbags is/are controlled by an associated valve disposed between the airbag and an air pump. Each or a set of airbags within the same zone can be inflated by one or more air pumps. Each of the valves and/or the air pumps can be controlled electrically or digitally by the central processor automatically or manually by the user. One or more zonal pressure sensors can be incorporated into each or a set of airbags forming the pressure sensing zone to monitor an overall internal pressure of that zone.

Pressure data received by any of the one or more pressure sensing mechanisms and the one or more zonal pressure sensors are transmitted to and processed by the central processor, and it can be further fed to a user terminal that can be fully controlled by the user.

In certain embodiments, the central processor contains a pre-set of pressure data including, but not limited to, pressure distribution mapping data of one or more groups of population categorized by height, weight, gender, age and/or authenticity, etc. The pre-set of pressure data may include the data recorded during different sleeping positions by the present system, including, but not limited to, back, side, and stomach positions.

In certain embodiments, the present system can also be trained by different datasets obtained from users with different background, physical fitness, and characteristics associated with sleeping positions, either received by the present system, from a peer system or a database.

In certain embodiments, the user can select which dataset(s) to be fed into the present system.

In certain embodiments, the user can select which of the pressure sensing and response zones to be activated/deactivated and/or airbags to be inflated or deflated, and/or adjust the volume/flow rate of air pumped into/out of one or more airbags.

In certain embodiments, the central processor includes a plurality of integrated circuits, microprocessors, and chips to receive and process any signals and/or data obtained from the pressure sensing mechanisms, zonal pressure sensors, and/or any external device or system, and provide instructions to the one or more actuators in response to the sensed signals/data automatically or according to the preference of actuation selected by the user manually.

In certain embodiments, the central processor is built based on a multi-layered artificial neural network structure in order to provide machine learning capacity.

In certain embodiments, the user terminal that allows the user to obtain data from, adjust different parameters of, and control operations of the present system can include, but not limited to, a computer terminal, a remote control, and a portable device.

In certain embodiments, the present system further includes a power supply and/or an energy storage element. In other embodiments, the present system is rechargeable by an external power supply.

The bedding articles can include, but not limited to, a pillow, mattress, any support element for human being, shock absorbing and reactive pad, etc.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects of the present invention are disclosed as illustrated by the embodiments hereinafter.

BRIEF DESCRIPTION OF DRAWINGS

The appended drawings, where like reference numerals refer to identical or functionally similar elements, contain figures of certain embodiments to further illustrate and clarify the above and other aspects, advantages and features of the present invention. It will be appreciated that these drawings depict embodiments of the invention and are not intended to limit its scope. The invention will be described and explained with additional specificity and detail through the use of the accompanying drawings in which.

Figure 1:
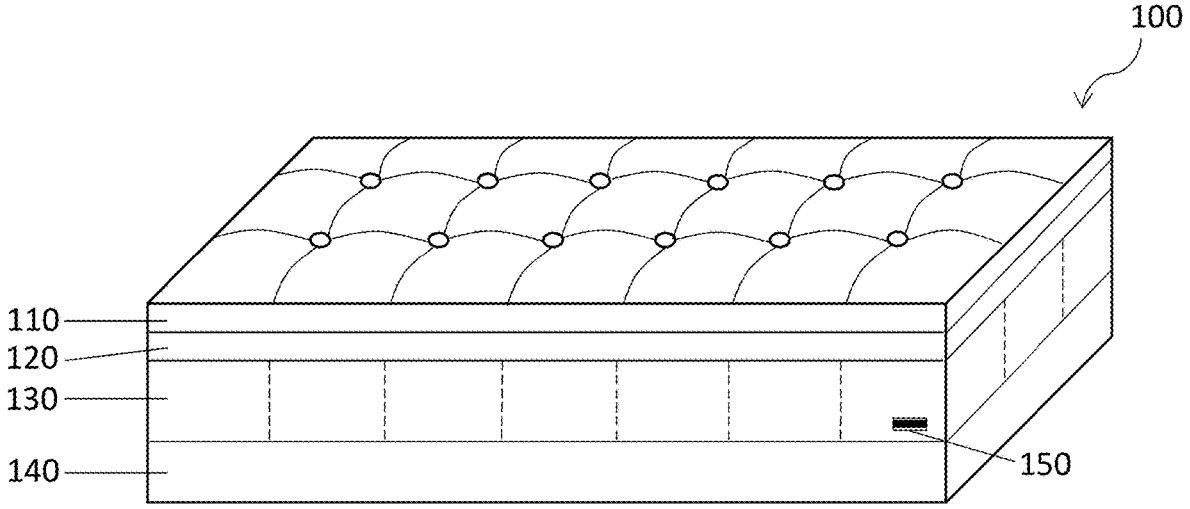
FIG. 1 schematically depicts a bedding article incorporated with the present system according to an embodiment of the present invention.

Skilled artisans will appreciate that elements in the figures are illustrated for simplicity and clarity and have not necessarily been depicted to scale.

DEFINITIONS

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Value in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a concentration range of "about 0.1% to about 5%" should be interpreted to include not only the explicitly recited concentration of about 0.1 wt. % to about 5 wt. %, but also the individual concentrations (e.g., 1%, 2%, 3%, and 4%) and the sub-ranges (e.g., 0.1% to 0.5%, 1.1% to 2.2%, and 3.3% to 4.4%) within the indicated range.

In the methods of preparation described herein, the steps can be carried out in any order without departing from the principles of the invention, except when a temporal or operational sequence is explicitly recited. Recitation in a claim to the effect that first a step is performed, and then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first, step E is carried out last, and steps B, C, and D can be carried out in any sequence between steps A and E, and that the sequence still falls within the literal scope of the claimed process. A given step or sub-set of steps can also be repeated.

DETAILED DESCRIPTION OF THE INVENTION

It will be apparent to those skilled in the art that modifications, including additions and/or substitutions, may be made without departing from the scope and spirit of the invention. Specific details may be omitted so as not to obscure the invention; however, the disclosure is written to enable one skilled in the art to practice the teachings herein without undue experimentation.

The present invention incorporates the pressure sensing and response mechanisms and the actuator system disclosed in a co-pending PCT application under the application number PCT/CN2021/122537 into the present system for providing a larger pressure sensing and response surface area and a user experience learning mechanism to allow a more interactive and personalized bedding article according to the background, physical fitness, and also preference of a user.

Accordingly, FIG. 1 depicts an example of a bedding article 100, which is a mattress or a large surface area pad, incorporated with the present system according to certain embodiments of the present invention. In this example, the bedding article 100 includes a topping layer 110 which is the most proximal layer to the body of the user. The topping layer 110 is usually soft with certain elasticity. A top surface of the topping layer 110 is a surface in contact with the body of the user while a bottom surface is a surface in contact with one or more layers or structures of the present system.

Figure 3:
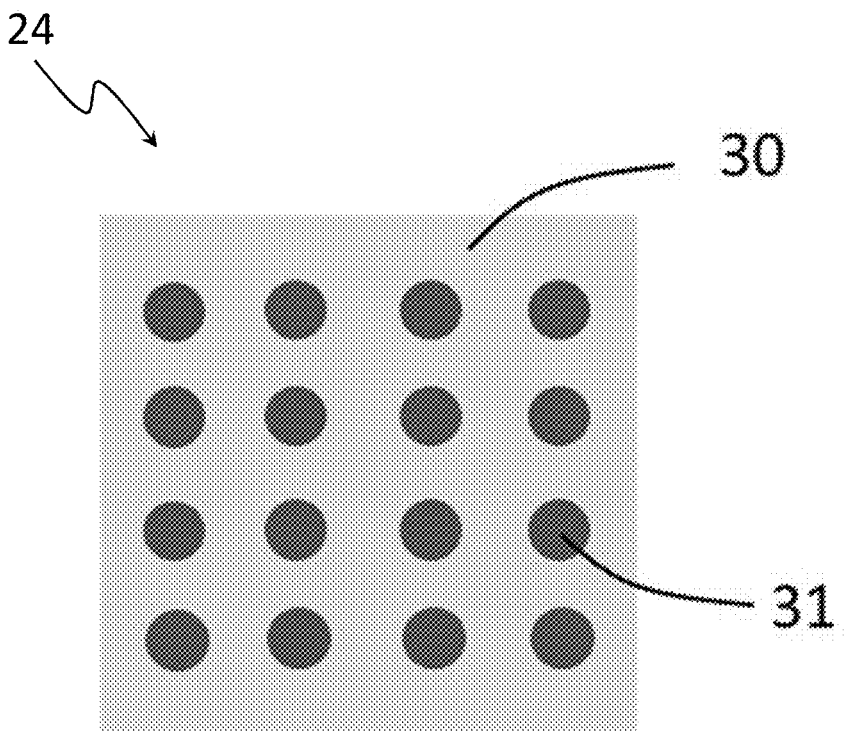
FIG. 3 schematically depicts the structure of the pressure sensing layer according to an embodiment of the present invention.

Disposed under the topping layer 110 is a pressure sensor mat 120 which is flexible with a plurality of pressure sensors and electrodes to convert the pressure signals into electric current and subsequently as digital signals to be further analyzed and processed by the present system. In order to provide a flexible whilst sensitive pressure sensory mat 120, the pressure sensing layer is preferably made of conductive and flexible materials such as conductive fabrics and deposited with piezoelectric or piezoresistive materials at certain areas throughout the whole surface. FIG. 3 depicts an example of the pressure sensing layer deposited with piezoresistive materials at designated areas according to certain embodiments of the present invention. The pressure sensory mat 120 can be a continuous sheet structure or include a plurality of sensory assays being communicated with each other to form a sensing structure.

Figure 5A:
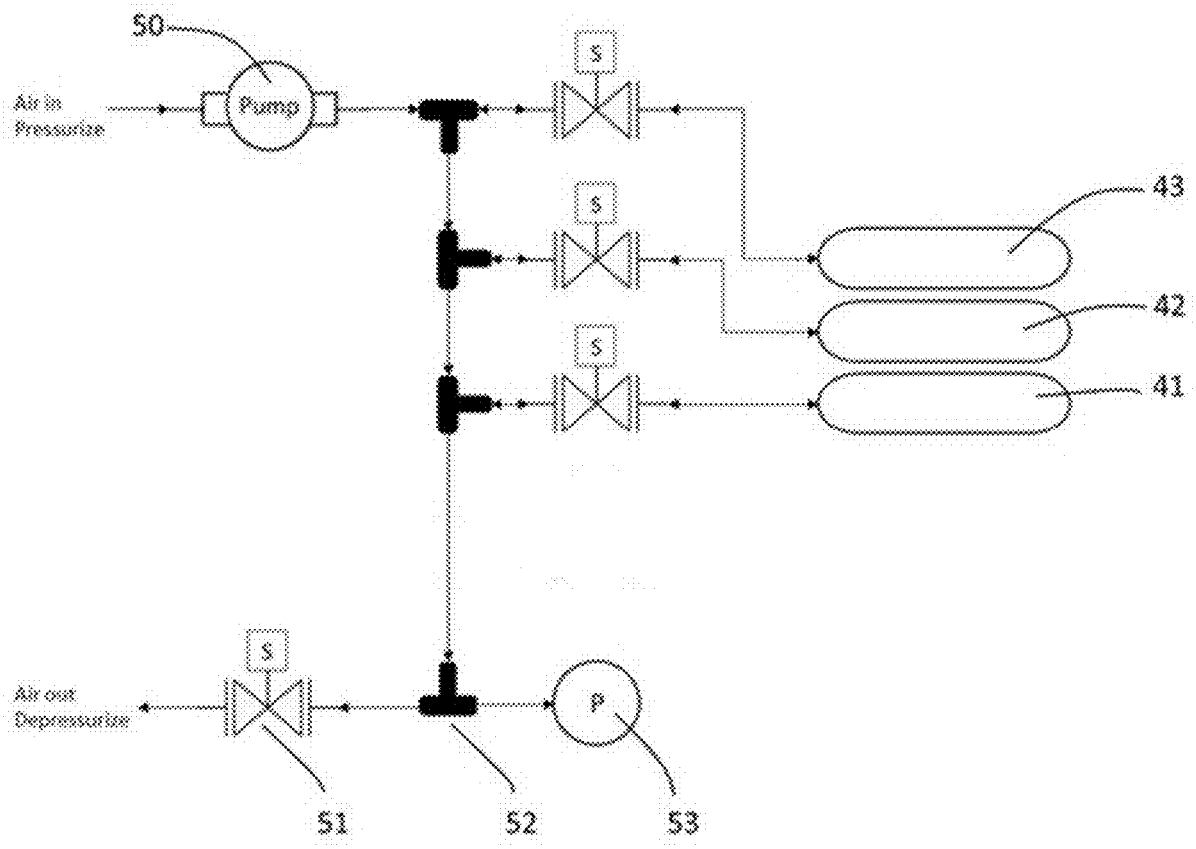
FIG. 5A schematically depicts how actuation in a pressure sensing and response zone is controlled according to an embodiment of the present invention.

Disposed under the pressure sensory mat 120 is an actuator system 130 being separated into a plurality of compartments (represented by dotted lines) each accommodating one or more actuators, one or more valves, and/or optionally zonal pressure sensor (an example of the actuation system is shown in FIG. 5A). In FIG. 1, an external port 150 is provided to connect the actuator system with an external power supply or any external devices. In some embodiments, power can be supplied to the actuators via other possible means including, but not limited to, wireless charging through conductive coils or electromagnetic field. Optionally, a filling layer can be disposed between the pressure sensor mat 120 and the actuation system 130 to provide the user with an additional comfort.

Disposed under the actuation system 130 is a bottom layer 140 to provide support for the loading of the bedding article 100 and also protect the actuation system 130. Since this is a loading support and backing of the bedding article 100, materials or mechanism used to form the bottom layer 140 can be relatively more rigid than those for the topping layer 110. In some embodiments, the bottom layer 140 can also be a flexible layer that is inflatable by any possible medium such as air or water.

Figure 2:
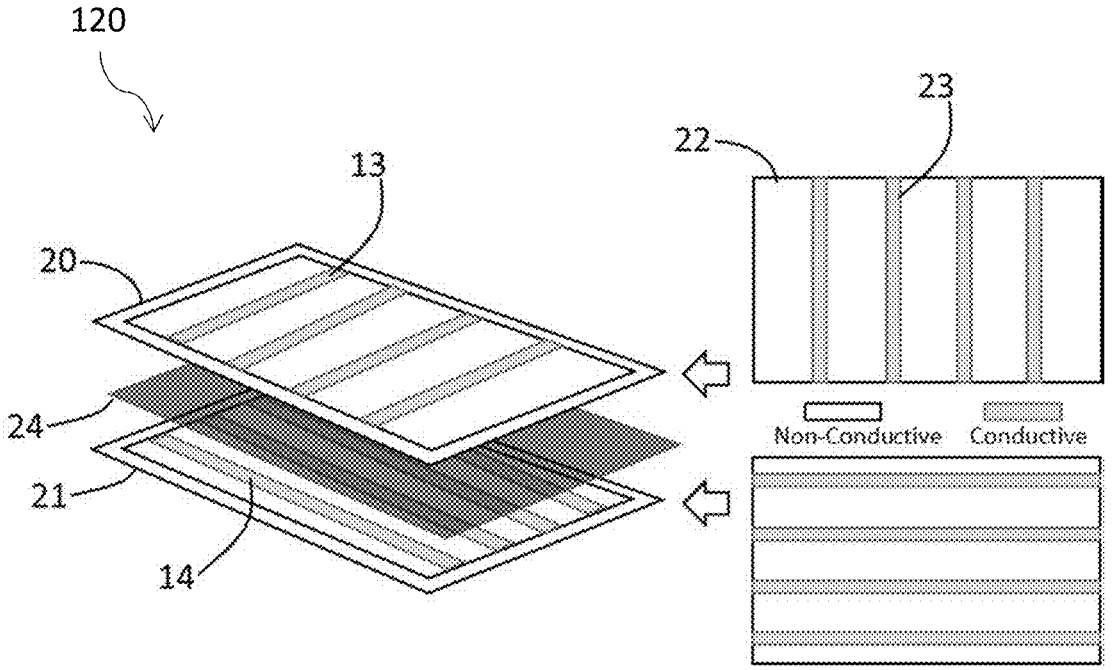
FIG. 2 schematically depicts the structure of the pressure sensing mechanism according to an embodiment of the present invention.

Turning to FIG. 2, a pressure sensing mechanism being fabricated into a pressure sensor mat 120 including a pressure sensing layer 24 sandwiched between a top electrode 20 and a bottom electrode 21. Each of the top electrode 20 and bottom electrode 21 includes multiple non-conductive regions 22 and conductive regions 23 alternately interlaced with each other. Each of the conductive regions 23 includes one or more conductive columns 13, or one or more conductive rows 14, in the top electrode 20 and bottom electrode 21, respectively. The conductive columns 13 in the top electrode 20 and conductive rows 14 in the bottom electrode sheet 21 extend in a vertical and longitudinal directions, respectively.

In certain embodiments, the width of the conductive columns 13 and the conductive rows 14 are approximately in a range from 1 mm to 100 mm, or preferably from 5 mm to 50 mm, or the width can be tuned based on the application requirement. In addition, the conductive columns 13 or conductive rows 14 are usually spaced apart by the non-conductive region 22 with a space in a range approximately from 1 mm to 100 mm, or preferably from 5 mm to 50 mm, depending on the resolution requirement of the pressure sensor mat. The crossing point or overlaying area where each of the conductive columns 13 intersects with each of conductive rows 14 is characterized as one sensor.

In certain embodiments, the pressure sensing layer is not a continuous, single layer. In those embodiments, the pressure sensing layer may be composed of multiple pressure sensors where each of them has its corresponding electrodes. In some embodiments, each pressure sensor, its corresponding electrodes and corresponding actuator(s) define a pressure sensing and response zone of the present system. In other words, the corresponding electrodes of each of the pressure sensor can operate independently from any neighboring electrodes of the other pressure sensor. By such a configuration, it may avoid any failure or disruption of electrical connection among a series of sensors if there is only one single electrode electrically connecting those pressure sensors along either longitudinal or vertical axis as in some conventional pressure sensing mat or pillow. A discontinuous pressure sensing layer under multiple pressure sensing and response zones may also enhance pressure sensitivity and response specificity to a particular sleeping posture.

Turning to FIG. 3, the pressure sensing layer 24 includes non-conductive fabric 30 and piezoresistive ink coated in several pre-defined areas 31.

In an exemplary embodiment, the pressure sensing layer 24 is made of piezoelectric materials having a high initial resistivity such as piezoresistive ink, and is sandwiched between the top electrode 20 and the bottom electrode 21. In certain embodiments, the conductive materials in the piezoresistive ink can include one or more of conductive polymer, nano material, and binder such that it does not only provide piezoresistance but also strengthen adhesion to the fabrics. The sheet resistance of the pressure sensing layer 24 is at about or greater than 50 K ohm/square to minimize crosstalk one sensor with the neighboring sensors, in particular, in a large area pressure sensor mat where multiple sensors can be pressed at the same time. In other embodiments, the sheet resistance of the pressure sensing layer 24 is adjustable by adjusting the concentration of conductive material in order to tune the overall resistance of the piezoresistive ink. Viscosity of the ink is also tunable according to the selected printing/coating method such as spray coating or dispensing. In order to maintain a soft feeling during contact, it is preferred to coat the fabric partially with the ink in the designated sensing areas 31 instead of the whole fabric.

In other embodiments, the pressure sensing layer 24 can be a textile made of piezoresistive yarns. The piezoresistive yarns have high resistivity and can be woven or knitted into blank fabric without pattern. The resistivity of the piezoresistive layer can limit the sensitivity and sensing range of sensors. Piezoresistive fabric used to form the pressure sensing layer of the present invention can include, but not limited to, cotton fabric, blended fabric and synthetic fabric such as polyester and LYCRA, or any fabric that can provide certain elasticity to the pressure sensor mat.

To establish a complete circuit for each of the sensors, the designated areas 31 deposited with the piezoresistive ink on the pressure sensing layer 24 preferably aligns with the intersects between the conductive columns 13 in the top electrode 20 and the corresponding conductive rows 14 in the bottom electrode 21. In addition, the pressure sensing layer 24 is optimized to achieve a uniform conduction path between the top electrode 20 and the bottom electrode 21 for each of the sensors on the pressure sensor mat 120.

With a continuous pressure data collected over time through the pressure sensor mat 11, an actuator system 130 is provided to adjust the support through an instant change of shape of the bedding article in response to any significant change in pressure from a preceding time to a present time. The actuator system 40 in the present invention includes one or more airbags each of which is preferably made of flexible materials including, but not limited to, rubber, forming multiple actuation zones of the bedding article.

Figure 4:
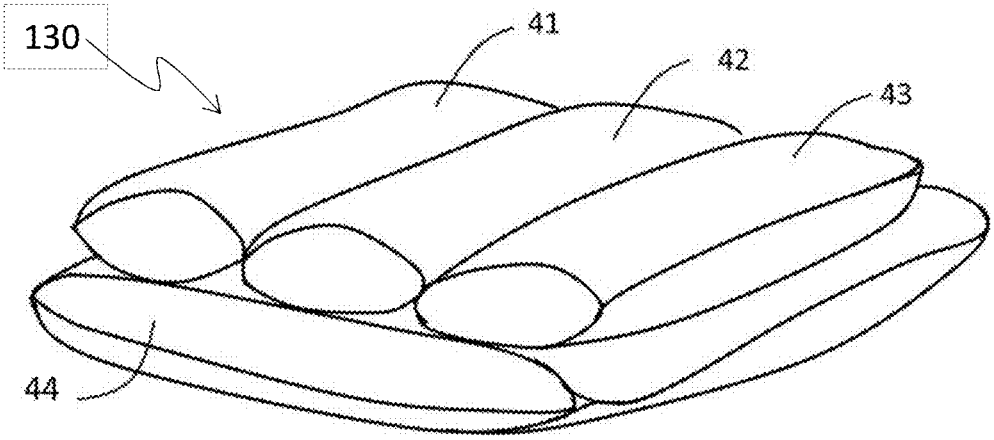
FIG. 4 schematically depicts a set of actuators configured to operate in multiple pressure sensing and response zones according to an embodiment of the present invention.

FIG. 4 shows a set of airbags arranged in an actuator system 130 including two layers, i.e., a top layer including three airbags and a bottom layer. The bottom layer 44 can be a layer of flexible materials including, but not limited to, an air-tight, liquid-sealed, or soft material-filled pad/cushion layer made of flexible polymers. The actuation system is configured to allow the state and/or volume of inflation/deflation of the airbags (41, 42, 43) to be adjusted separately or in any combination in order to achieve certain overall height adjustment of the actuation system 130, and in turn adjust the overall height or a particular zone of the bedding article. In an exemplary embodiment, the airbags (41, 42, 43) are disposed under a topping layer (not shown in FIG. 4) such as a memory foam or fibrous cover sheet, and the pressure sensor mat 11 may be disposed above the topping layer and the actuator system 40. The pressure sensing mechanisms in the pressure sensor mat 120 can monitor pressurized condition and contact condition of the actuator system 130. Optionally, the actuation system 40 may include one or more internal pressure sensors to monitor the pressure within or exerted on one or a set of airbags, apart from the pressure sensing mechanisms in the pressure sensor mat 11. In addition, each airbag or the set of the airbags within the same pressure sensing and response zone is configured to seal air at its inflated state to avoid air leakage. In one embodiment, the lifting displacement for each airbag is approximately from 0 mm to 500 mm, preferably from 1 to 100 mm, and more preferably from 10 to 50 mm.

Figure 5B:
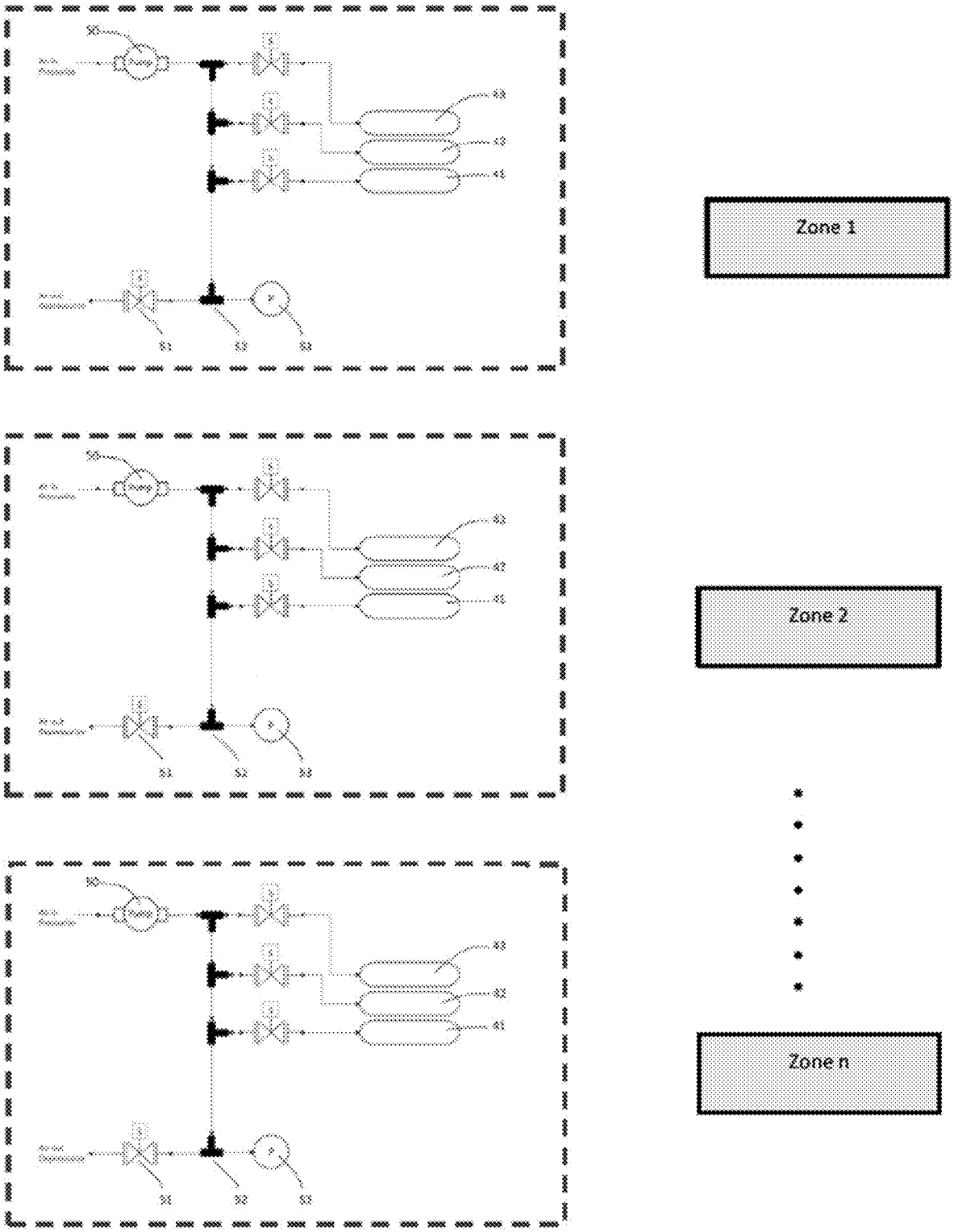
FIG. 5B schematically depicts individual actuation by each of the pressure sensing and response zones according to certain embodiments of the present invention.
Figure 8:
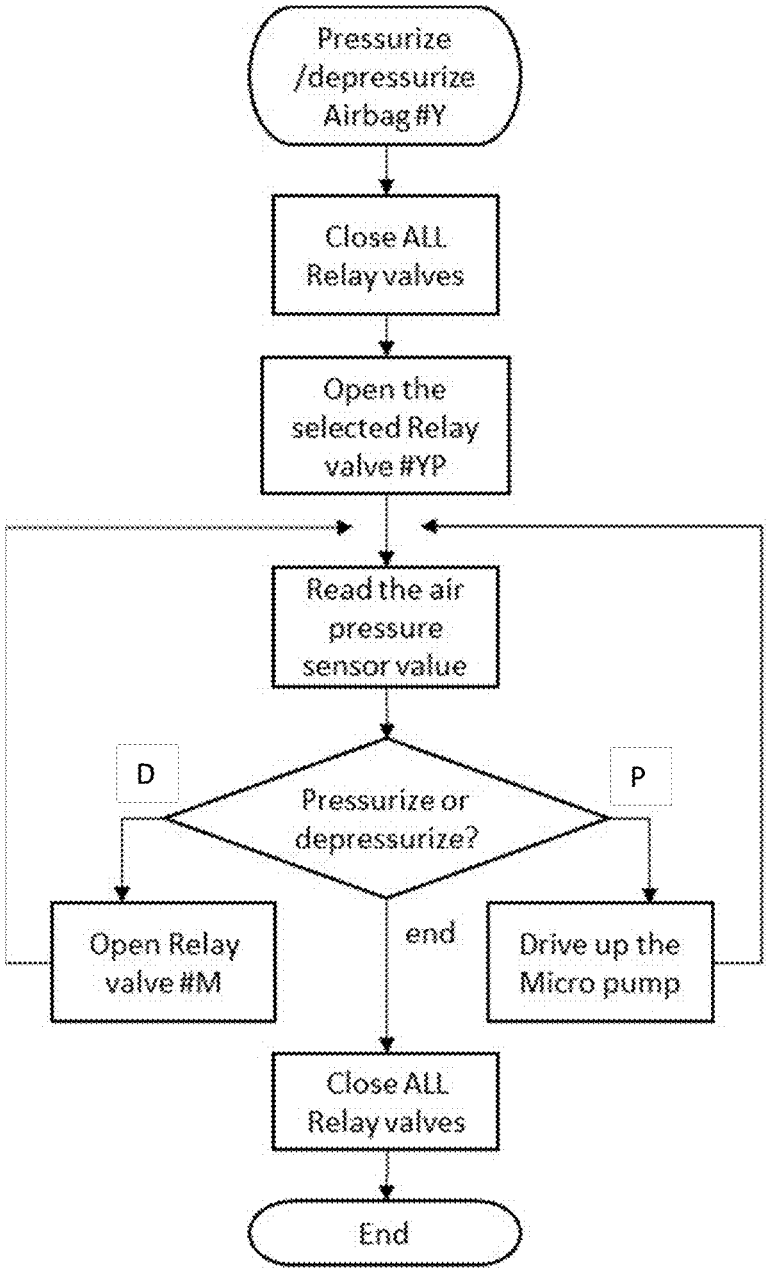
FIG. 8 shows a flow chart of how air inflation and deflation in one of a set of actuators are controlled according to an embodiment of the present invention.

Turning to FIG. 5A, the airbags in each of the pressure sensing and response zones are connected to relay valves 51 and T-connector tube joint 52 through flexible silicone tubes. Together with a micro pump 50 and other necessary components such as internal pressure sensor 53, the airbags can be individually controlled to convert the airbags between an inflated configuration corresponding to an increasing volume of the airbags and a deflated configuration corresponding to a decreasing volume of the airbags. According to the contact pressure distribution, the control unit gives command to relay valves 51 to open or close based on manual or automatic adjustment through an algorithm. Respective relay valves 51 disposed at different positions of the actuation system can provide an individual control or an overall control of the pressure within each or a set of airbags (41, 42, 43) of the actuation system. FIG. 5B illustrates corresponding actuations in terms of controlling the pressure level of the airbag(s) are executed individually in different pressure sensing and response zones. FIG. 8 shows as a flow diagram how pressurization and depressurization of the airbag are decided and executed according to one embodiment of the present invention.

Figure 6:
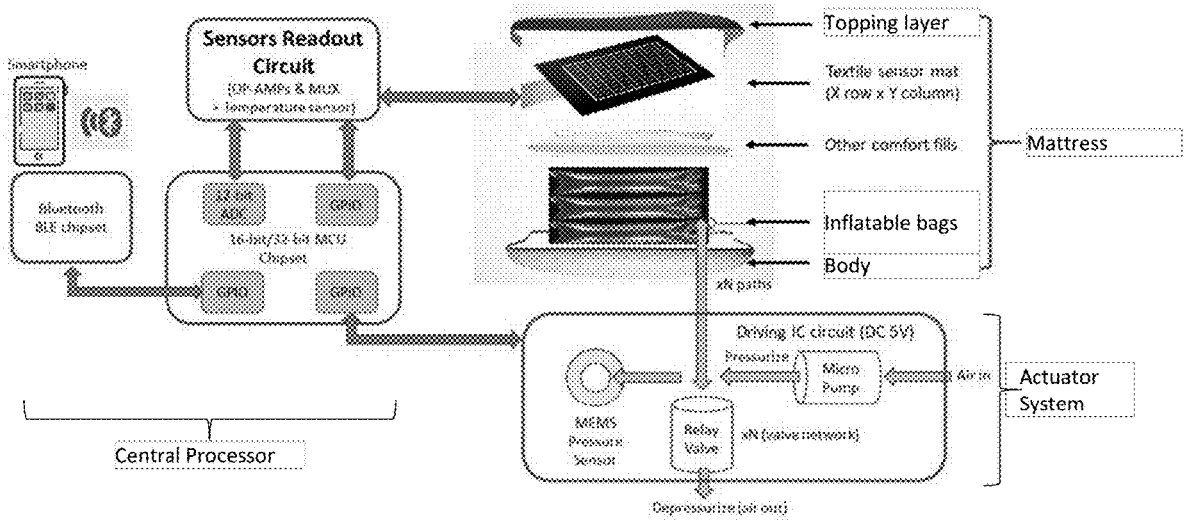
FIG. 6 schematically depicts interactions between different modules of the present system according to certain embodiments of the present invention.

FIG. 6 is a schematic diagram showing different parts/modules of the present invention and how they interact with each other. In one embodiment, the central processor includes a set of integrated circuits (ICs) such as Op-AMP and MUX circuits to read the voltage output signal of voltage-current converter amplifier probed to each sensor on the pressure sensor mat 120. In other embodiment, there is also provided a MEMS IC to read the internal pressure data from the actuator system 40. All these voltage signals will then be converted to digital signal by multiple channels of ADC converter built-in in the 16-bit/32-bit MCU IC. A set of ICs (motor driver) circuit is also provided to drive the micro pump 50 and relay valves 51.

Figure 7:
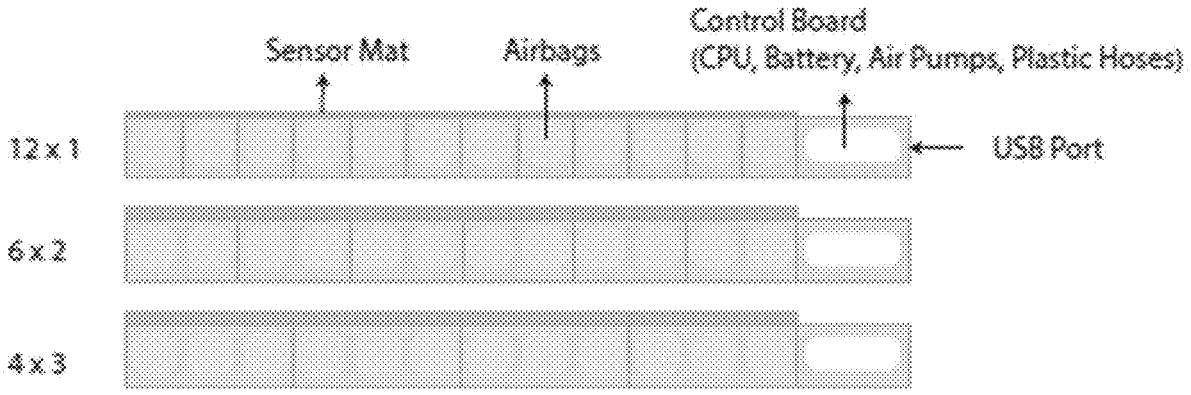
FIG. 7 schematically depicts different combinations of actuators in the pressure sensing and response zones according to certain embodiments of the present invention.

Turning to FIG. 7, different embodiments of the present invention in terms of how the airbags are arranged in a bedding article are depicted. In FIG. 7, a mattress segmented into two, three and twelve compartments, respectively, for accommodating one or more airbags and the pressure sensing mechanism are taken as an example for illustration only, which should not be considered as limiting the scope of the present invention. In one embodiment, each airbag is arranged independently from each other, resulting in a 12×1 compartment arrangement. In other embodiment, every two airbags are arranged in each compartment to result in a 6×2 compartment arrangement. In another embodiment, every three airbags are arranged in each compartment to result in a 4×3 compartment arrangement. The number of compartments and/or the number of airbags in each of the compartments could be adjusted according to the preference of the user.

Turning to FIG. 8, the user of a bedding article incorporated with the present system can control air inflated or deflated into each of the individual airbags of the same pressure sensing and response zone on a simple user interface at a connected user terminal such as a portable device. Initially, when a user switches on the corresponding user interface, it will prompt the user to select whether a designated airbag of the bedding article, for example, a mattress, is to be pressurized/depressurized. If the answer is yes, all the valves disposed between the air micro pump and the corresponding airbag(s) will be closed. Subsequently, the corresponding valve to the designated airbag will be opened, and the air pressure is measured by a zonal pressure sensor to determine the internal pressure of the designated airbag. After reading the pressure value of the designated airbag, the user can decide whether to send the instruction to open another valve of a neighboring airbag, close all the valves, or to drive up the micro pump in order the withdraw the air from the designated airbag. The internal pressure of the designated airbag (and neighboring airbag) will be measured again and the data of which will be sent to the user's portable device. What if the user has decided to end the inflation/deflation cycle, all the valves associated with the designated airbag will be closed.

Figure 9:
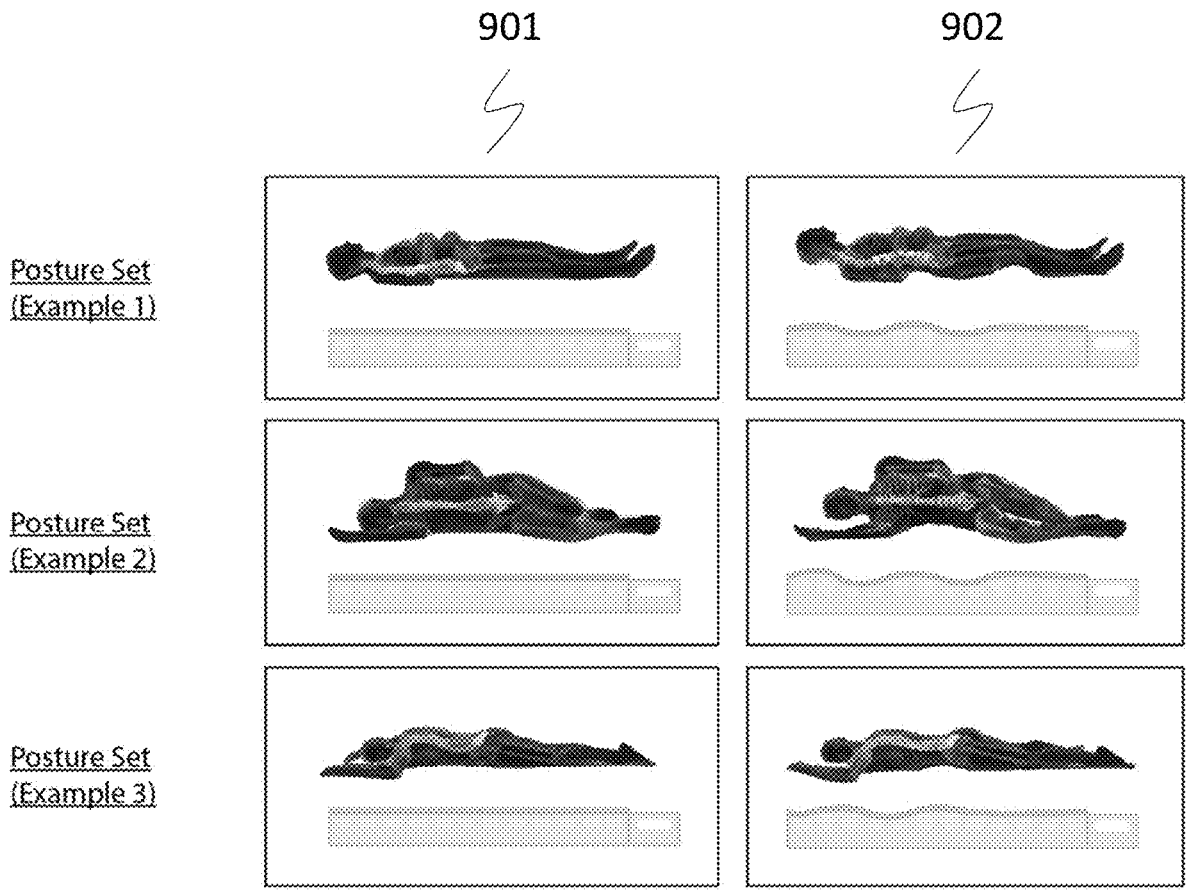
FIG. 9 schematically depicts how different pressure sensing and response zones operate in response to different sleeping postures according to certain embodiments of the present invention.

FIG. 9 illustrates how different pressure sensing and response zones may be adjusted in response to different sleeping positions. The three most common sleeping positions, back, side, and stomach positions, are taken as examples for illustration in FIG. 9. 901 represents a posture sensing and recording stage while 902 represents a response stage. It should be noted that the posture sensing, recording and response cycle can be repeatable and the two stages may or may not be in sequence throughout a sleeping course or session.

In Example 1, when the sleeping posture of a user is a back (supine) position, according to the curvature of the back of the user and corresponding detected pressure levels at different pressure sensing points of the pressure sensory mat, the present system will suggest which part(s) of the user's body should be provided with more support, and let the user to decide the state and/or degree of inflation/deflation of a particular or a zone of inflatable actuators (i.e., airbag in various embodiments). Alternatively, the user may select automatic adjustment mode to let the present system to decide the state and/or degree of inflation/deflation of one or more airbags according to various factors including, but not limited to, instantaneous pressure data from the pressure sensory mat, trained models stored in a corresponding database/network, and user's experience/preference. In Example 1, after sensing and analysing the pressures exerted on different pressure sensing points of the pressure sensory mat, the pressure level of the corresponding actuators in the pressure sensing and response zones adjacent to shoulder, waist and hip sections at the back of the user have been adjusted.

Example 2 in FIG. 9 illustrates how the present system may counteract another sleeping position, side position. If the user sleeps in this position, more support will be required for the zones adjacent to the head section, whereas shoulder and hip sections may need less support. In this example, one of the thighs which is more distal to the contact surface of the bedding article (in this illustration, it is left thigh when the user on right side of his/her body) will need more support than the other. Accordingly, the corresponding pressure sensing and response zone and its associated actuator(s) will be activated/inflated in order to increase the overall height of that zone to provide additional support for that thigh. In one embodiment, the corresponding actuation of the associated actuator(s) in a particular pressure sensing and response zone is automatically executed by the present system after detecting the pressure distribution according to a sleeping position of the user for a sufficiently long period of time. In other embodiments, pressure level of the corresponding actuator(s) will be adjusted either automatically by the present system or manually by the user through a user terminal or a device communicating with the present system.

Example 3 in FIG. 9 illustrates the sensing and response mechanisms of the present system with respect to a third common sleeping position, stomach (prone) position. In this example, the most unsupported section(s) among the rest of the body appear to be the head and stomach sections, and therefore the present system will either activate/adjust the corresponding actuator(s) of the zones adjacent to those section of the user's body automatically or according to the instructions from the user after having the pressure information from the present system.

For simplicity of illustration, only one column of actuators is shown from a side view of a mattress in each example of FIG. 9, which should not be understood as limiting the change in state and/or degree of inflation/deflation to those actuators as shown.

To summarize, the present system includes multiple sensors capable of operating independently from each other, and those sensors include, but not limited to, pressure sensor, motion sensor, light sensor, temperature sensor, and humidity sensor, etc. The present system also includes a plurality of actuators such as inflatable airbags controlled by corresponding air valve(s) in order to respond to a sleeping posture captured at one instance. The data obtained from the multiple sensors are received and processed by a central processor or processing unit, which can be a computer system or a network of computers with or without machine learning or deep learning ability. The corresponding central processor or processing unit can also feed the received data or suggested action to one or more external devices including a user terminal under control by the user. The central processor or processing unit can also send instruction directly based on its own analysis or upon receipt of further instruction from the user to act on the inflation or deflation of the corresponding actuator(s) in response to the instantaneously captured sleeping posture. The present system can sense and respond to a series of sleeping postures real-time throughout a sleeping course or session, or until an active termination by the user. The present system can also optionally be connected to a cloud computing system or a server to store or retrieve data received from the sensors or from a comparable, authorized system or device. The present system can also be equipped with an automatic termination mechanism in case where there is an emergency causing harm to the user such as short circuit, current overflow, or certain system failure. Such an automatic termination mechanism can include, but not limited to, a load switch, integrated power MUX device, electronic fuses, hot swap controllers, ideal diode, ORing controllers, smart high-side or low-side switches.

Although the invention has been described in terms of certain embodiments, other embodiments apparent to those of ordinary skill in the art are also within the scope of this invention. Accordingly, the scope of the invention is intended to be defined only by the claims which follow.

INDUSTRIAL APPLICABILITY

The present invention does not only apply to specialized bed pad or mattress for sports training, medical and rehabilitation purposes, but also to regular bedding articles because the present system provides an easy-to-understand pressure data analysis and suggested correction actions for regular users, instead of complicated pressure distribution map that most of the conventional systems/devices aim to generate.

What is claimed is:

1. A personalized, sleeping posture correction system for a bedding article, the system comprising:

a three-dimensional body for a user of the bedding article to sleep thereon being segmented into a plurality of compartments defining a plurality of pressure sensing and response zones;

a pressure sensing and response module being disposed in each of the pressure sensing and response zones comprising one or more pressure sensing mechanisms and one or more actuators, each of the pressure sensing mechanisms and each of the actuators having individual sensor and actuator circuits in each of the pressure sensing and response zones configured to generate pressure sensing signal and execute actuation instructions, respectively; and a central processor receiving pressure sensing signals from the one or more pressure sensing mechanisms, processing thereof, sending actuation instructions to the one or more actuators, feeding the processed pressure sensing signals to and receiving corresponding commands from one or more external devices, wherein the one or more pressure sensing mechanisms are one or more multi-layered structures comprising at least one pressure sensing layer and two electrode layers, and the at least one pressure sensing layer is a textile made of piezoresistive yarns, wherein the one or more actuators comprises a two-layer actuator structure including a top layer and a bottom layer, the bottom layer being a layer of flexible materials and disposed beneath and underlying the entire top layer, the top layer comprising a plurality of airbags configured to be adjustable for adjusting overall height of the one or more actuators.

2. The system of claim 1, wherein the at least one pressure sensing layer is made of a plurality of electrically conductive fibers.

3. The system of claim 2, wherein a first electrode layer of the two electrode layers comprises a plurality of first conductive portions and a plurality of first non-conductive portions interlaced with each other.

4. The system of claim 3, wherein the at least one pressure sensing layer comprises a plurality of sensory spots evenly or unevenly distributed throughout each of the contact surface areas with the corresponding electrode layer.

5. The system of claim 4, wherein a second electrode layer comprises a plurality of second conductive portions and a plurality of second non-conductive portions interlaced with each other, and the second conductive portions are oriented in a direction substantially perpendicular to that of the first conductive portions of the first electrode layer.

6. The system of claim 5, wherein at where the first conductive portions of the first electrode layer intersect with the second conductive portions of the second electrode layer are where the plurality of sensory spots disposed onto each of the contact surfaces of the at least one pressure sensing layer, and wherein at each of the sensory spots is deposited with piezoresistive inks.

7. The system of claim 1, wherein each of the actuators comprises one or more inflatable sealed containers, one or more valves, a zonal air pressure sensor, and an air pump.

8. The system of claim 7, wherein the air volume, rate, and direction of flow in or out of each of the inflatable sealed containers are controlled by each of the valves separately from each other whilst the air pressure in each of the actuators is regulated by the zonal air pressure sensor and the air pump.

9. The system of claim 1, wherein the central processor comprises a plurality of integrated circuits, microprocessors, and chips to receive and process any signals and/or data obtained from the pressure sensing mechanisms, zonal pressure sensors, and/or any external device, and provide instructions to the one or more actuators in response to the sensed signals/data automatically or according to preference of actuation selected by the user manually.

10. The system of claim 1, wherein the central processor is connected to a user terminal and/or one or more external devices to exchange data among the central processor and any of the user terminal and/or external devices, and wherein the user terminal and/or external devices comprise mobile communication device, portable electronic device, remote control, computer gateway, network and/or data servers, cloud computing system, and peer system thereof within the same or from a different network.

11. The system of claim 10, wherein after processing the pressure sensing data obtained from the pressure sensing and response module, and prior to sending actuation instructions to the actuators, the central processor is configured to provide one or more suggested actuation protocols to the user through the user terminal and/or external devices.

12. The system of claim 11, further comprising an image capturing module for capturing one or more images of an instantaneous sleeping posture of the user, wherein the central processor receives, analyze, and processes image data obtained from the image capturing module together with the pressure sensing data obtained from the pressure sensing and response module to provide said suggested actuation protocols to the user.

13. The system of claim 12, wherein the image capturing module comprises one or more image capturing devices, one or more image processors, and a data transmission device, and wherein the one or more image capturing devices comprise one or more motion sensors.

14. The system of claim 1, wherein the central processor is trained with a plurality of datasets in relation to pressure distribution on a comparable bedding article arising from different sleeping postures of a comparable human being to the user with corresponding sleeping posture correction protocols, and/or is pre-determined with a set of operational parameters according to the user's preference.

15. The system of claim 13, wherein the central processor is built based on a multi-layered artificial neural network.

16. The system of claim 1, wherein the bedding article is selected from a mattress or a large-area pad for the user to sleep thereon.

17. A bedding article comprising the system of claim 1.

18. A method for correcting sleeping posture of a user of a bedding article, comprising using the system of claim 1 in the bedding article, and the bedding article being selected from a mattress or a large-area pad for the user to sleep thereon.

* * * * *